US006267865B1

(12) United States Patent
Polson et al.

(10) Patent No.: US 6,267,865 B1
(45) Date of Patent: Jul. 31, 2001

(54) ELECTROCHEMICAL FLUORINATION USING INTERRUPTED CURRENT

(75) Inventors: Stephen D. Polson, St. Paul; Jeffrey C. Spangler, Eagan; Eric N. Wallace, St. Paul; John C. Smeltzer, Woodbury, all of MN (US); Charles F. Kolpin, River Falls, WI (US); Ludmila M. Groubina, deceased, late of S.-Petersburg (RU), by Anna Dmetrievna, legal representative; Galina I. Kaurova; Anatoly A. Krasilnikov, both of S.-Petersburg (RU); Adda E. Gandlina, Bonn (DE)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/464,781

(22) Filed: Dec. 17, 1999

Related U.S. Application Data

(63) Continuation-in-part of application No. 09/074,830, filed on May 8, 1998, now abandoned, and a continuation of application No. 09/070,382, filed on Apr. 30, 1998, now abandoned.

(60) Provisional application No. 60/045,514, filed on May 2, 1997.

(51) Int. Cl.[7] ..... C25B 1/00; C25B 3/08

(52) U.S. Cl. ..... 205/341; 205/460

(58) Field of Search ..... 205/341, 460

(56) References Cited

U.S. PATENT DOCUMENTS

| | | | |
|---|---|---|---|
| 2,519,983 | 8/1950 | Simons | 204/62 |
| 2,713,593 | 7/1955 | Brice et al. | 260/535 |
| 3,028,321 | 4/1962 | Danielson et al. | 204/59 |
| 3,692,643 | 9/1972 | Holland | 204/59 R |
| 4,739,103 | 4/1988 | Hansen et al. | 560/125 |
| 5,286,352 | 2/1994 | Hansen et al. | 204/59 F |

(List continued on next page.)

FOREIGN PATENT DOCUMENTS

| | | |
|---|---|---|
| 2 604 189 | 3/1988 | (FR) . |
| 741399 | 11/1955 | (GB) . |
| 785492 | 10/1957 | (GB) . |
| WO 94/13857 | 6/1994 | (WO) . |

OTHER PUBLICATIONS

Alsmeyer, Y.W. et al., "Electrochemical Fluorination and its Applications", *Organofluorine Chemistry: Principles and Commercial Applications,* Edited by R.E. Banks et al., Chapter 5, pp. 121–143 (1994) No month available.

Burdon, J. et al., "The Electrochemical Process for the synthesis of Fluoroorganic Compounds", *Advances in Fluorine Chemistry,* Edited by M. Stacey et al., vol. 1, pp. 129–165 (1960) No month available.

(List continued on next page.)

*Primary Examiner*—Edna Wong

(57) ABSTRACT

Described is a process for the electrochemical fluorination of a substrate, the process comprising the steps of: providing a substrate comprising at least one carbon-bonded hydrogen; preparing a reaction solution comprising the substrate and hydrogen fluoride; passing electric current through the reaction solution sufficient to cause replacement of one or more hydrogens of the substrate with fluorine, the electric current being interrupted through a current cycle defined by current levels comprising an elevated current and a reduced current; wherein the current varies in such a manner that the resistance of the cell operated with interrupted current is lower than the resistance of the cell operated with non-interrupted current.

37 Claims, 4 Drawing Sheets

U.S. PATENT DOCUMENTS

| | | | |
|---|---|---|---|
| 5,322,597 | 6/1994 | Childs et al. | 204/59 F |
| 5,387,323 | 2/1995 | Minday et al. | 204/59 F |
| 5,474,657 | 12/1995 | Hansen | 204/59 F |

OTHER PUBLICATIONS

Childs, W.V. et al., "Anodic Fluorination", *Organic Electrochemistry, An Introduction and a Guide,* Edited by Henning Lund et al., Marcel Dekker Inc., New York (1991) No month available.

Donohue, J.A. et al., "Pulsed Electrolysis of Wet Hydrogen Fluoride", *J. Electrochem. Soc.,* vol. 115, No. 10, pp. 1039–1042 (Oct. 1968).

Donohue, J.A., et al., "The Nickel/Nickel Fluoride Anode in Wet Hydrogen Fluoride", *J. Electrochem. Soc.,* vol. 115, No. 10, pp. 1042–1045 (Oct. 1968).

Nagase, "Electrochemical Fluorination," *Fluorine Chemistry Reviews,* Edited by Paul Tarrant, vol. 1, No. 1, pp. 77–106 (1967).

Noel, et al., "A Review of Recent Developments in the Selective Electrochemical Fluorination of Organic Compounds", *J. of Fluorine Chem.,* vol. 83, pp. 31–40 (1997) No month available.

Rudge, A.J., "Electrochemical Fluorination," *Industrial Electrochemical Processes,* Edited by A.T. Kuhn, Chapter 2, pp. 71–88 (1971) No month available.

Saffarian, H. et al., "Electrochemical Properties of Perfluoroalkane Disulfonic $[HSO_3(CF2)_nSO_3H]$ Acids Relevant to Fuel Cell Technology", *J. Electrochem. Soc.,* vol. 139, No. 9, pp. 2391–2397 (Sep. 1992).

Simons, J.H. *Fluorine Chemistry,* Academic Press, Inc., New York, vol. 1, pp. 414–420 (1950) No month available.

Watanabe et al., "Electrochemical Fluorination of Acetonitrile", Asahi Garasu Kogyo Gijutsu Shoreikai Kenkyu Hokoku, Volume Date 1975, vol. 27, pp. 1–10, No month available.

ELECTROCHEMICAL FLUORINATION USING INTERRUPTED CURRENT

CROSS-REFERENCE TO RELATED APPLICATION

This application is a continuation-in-part of application Ser. No. 09/070,382, filed Apr. 30, 1998, now abandoned, and claims the benefit of U.S. Provisional Patent Application No. 60/045,514, filed May 2, 1997; this application is further a continuation-in-part of application Serial No. 09/074,830, filed May 8, 1998, now abandoned.

FIELD OF THE INVENTION

The present invention relates to a process for the electrochemical fluorination of organic materials.

BACKGROUND

Fluorochemicals (e.g., fluorinated and perfluorinated organic compounds) are commercially valuable and useful chemical materials. Fluorochemicals can exhibit various useful properties, e.g., they may be inert, nonpolar, hydrophobic, oleophobic, etc. As such, fluorochemicals can be useful in a wide variety of applications. They can be useful as oil, water, and stain resistant chemicals; they can be useful as refrigerants and heat exchange agents; or as solvents and cleaning agents. Due to the versatility of fluorochemicals, and a consequent strong demand for these materials, there is a continuing need in the fluorochemical industry for new and improved methods of preparing fluorochemicals.

One well-known industrial process for preparing fluorochemical compounds is the electrochemical fluorination process commercialized initially in the 1950's by the 3M Company. This process, often referred to as Simons fluorination or electrochemical fluorination (ECF), is a method by which electric current is passed through an electrolyte solution containing a mixture of liquid anhydrous hydrogen fluoride and an organic compound intended to be fluorinated (the "substrate"). Generally it is taught that the Simons process is practiced with a constant current passed through the electrolyte; i.e., a constant voltage and constant current flow. See for example W. V. Childs, et al., *Anodic Fluorination in Organic Electrochemistry*, H. Lund and M. Baiser eds., Marcel Dekker Inc., New York, 1991. The current passing through the electrolyte causes one or more of the hydrogens of the substrate to be replaced by fluorine.

The Simons process of electrochemical fluorination, although commercially useful, includes aspects that might desirably be improved upon. For example, the Simons process requires a significant amount of electrical energy passing through the electrolyte solution. Much electrical energy is effectively used to fluorinate the substrate, but a certain amount of this electrical energy converts to heat energy that must necessarily be carried away from the electrochemical fluorination cell as wasted energy, and adds to the overall cost of operating the process. It would be desirable to reduce the amount of electrical energy that is wasted as dissipated heat energy in the Simons process, and thereby reduce the overall cost of electricity needed to operate this process.

Also, the conventional Simons process often includes the use of conductivity additives to allow the passage of current through the electrolyte solution. See for example J. Burdon and J. C. Tatlow, *The Electrochemical Process for the Synthesis of Fluoro- Organic Compounds*, Advances in Fluorine Chemistry, edited by M. Stacey et al., volume 1 p. 129 (1960). Conductivity additives can cause undesired results when used in the Simons process. Conductivity additives, for example, can interfere with the fluorination of the substrate, either by causing increased corrosion of the anode, or by themselves being consumed or fluorinated in the fluorination reaction. This can reduce the overall yield of the desired fluorinated product, and in many ways can increase the costs of the fluorination operation. Therefore, it would be desirable to reduce or even substantially eliminate the need for conductivity additives.

Finally, the Simons process can be difficult to maintain at steady state for extended periods of time because high resistance by-product films and tars can tend to accumulate on electrodes of the fluorination cell, specifically, at the anode. In normal operation, the accumulation of films and tars on the anode causes increased resistance of the electrochemical cell, and an upward drift in cell voltage. The problem can become more serious and lead to the condition referred to as "current blocking," which is manifested as a permanent increase of resistance and loss of conductivity within the cell. To correct current blocking often requires shut-down of the apparatus for cleaning. It would therefore be desirable to prevent increases in the resistance of a fluorination cell that can lead to loss of conductivity within the cell, and the permanent condition of current blocking.

SUMMARY OF THE INVENTION

The present invention relates to a process for the electrochemical fluorination of chemical compounds such as those containing organic moieties. In the process, a reaction solution is provided that comprises an organic substrate and hydrogen fluoride. An electric potential (voltage) is established across the reaction solution causing an electric current to pass through the reaction solution, and thereby causing fluorination of the organic substrate. In the method, the electric current is periodically and regularly interrupted, i.e., the current flows at a first current level, identified as an elevated current level, and is periodically interrupted to flow at a reduced current level. In the invention, the current is interrupted in such a manner that the resistance of the electrochemical fluorination (ECF) cell operated under the conditions of the present invention is lower than the resistance of the cell operated without interruption of the current.

Interrupting the electric current during fluorination offers a number of advantages over conventional electrochemical fluorination methods. As stated, the current can be interrupted in such a manner that the resistance of the fluorination cell will be reduced compared to the resistance of the same fluorination cell operating with uninterrupted current. The reduced cell resistance resulting from interrupted current in turn results in a lower cell voltage being required to achieve fluorination at constant current; i.e., the voltage between the anode and the cathode with interrupted electric current can be lower relative to the voltage of the same cell, operated with the same amount of current, wherein the current is interrupted. At the same time, because the cell resistance is comparatively lower, the amount of wasted heat energy created during the fluorination process is also reduced, reducing or eliminating the need to remove wasted heat energy from the fluorination cell. The achievement of a lower operating voltage allows stable cell operation at higher current densities, which in turn allows more product to be produced in a given time period, and extended production runs (e.g., days, weeks, etc.) without significant interruptions. At production scale, reduced cell voltage, reduced cell resistance, and increased current, result in a more efficient process with higher production rates of a fluorinated product, often at a lower cost. Furthermore, interrupted current can reduce or eliminate the need for conductivity additives in an electrochemical fluorination process. This can reduce corrosion of the electrodes within the fluorination cell, reduce the amount of energy and raw materials wasted due to fluorination of the conductivity additives themselves, and reduce unwanted by-products. In some cases, interrupted electric current increases the selectivity of the fluorination reaction resulting in higher yields and reduced by-products. All of these identified improvements advantageously reduce overall operation costs for the electrochemical fluorination process.

An aspect of the present invention relates to a process for fluorinating a substrate using an electrochemical fluorination cell. The process includes the steps of: (1) providing a substrate comprising at least one carbon-bonded hydrogen; (2) preparing a reaction solution comprising the substrate and hydrogen fluoride; (3) passing electric current through the reaction solution sufficient to cause replacement of one or more hydrogens of the substrate with fluorine. In the process, the electric current is interrupted through a cycle defined by current levels comprising an elevated current and a reduced current, and in such a manner that the resistance of the cell operated with interrupted current is lower than the resistance of the cell operated with uninterrupted current.

Another aspect of the present invention relates to a method for perfluorinating a substrate according to the above method.

A particular aspect of the present invention relates to a process for fluorinating an alkane substrate using an electrochemical fluorination cell. The process includes the steps of: (1) providing an alkane substrate comprising at least one carbon-bonded hydrogen; (2) preparing a reaction solution comprising the alkane substrate and hydrogen fluoride; (3) passing electric current through the reaction solution sufficient to cause replacement of one or more hydrogens of the alkane substrate with fluorine. In the process, the electric current is interrupted through a cycle defined by current levels comprising an elevated current and a reduced current, and in such a manner that the resistance of the cell operated with interrupted current is lower than the resistance of the cell operated with uninterrupted current.

Yet another particular aspect of the invention relates to a process for electrochemical fluorination including the steps of: providing a substrate having at least one carbon-bonded hydrogen; providing a fluorochemical in which the substrate is soluble; providing an electrochemical fluorination cell; providing hydrogen fluoride; introducing the substrate to the fluorochemical so that the substrate dissolves into the fluorochemical; introducing the hydrogen fluoride to the electrochemical fluorination cell; introducing the fluorochemical with substrate dissolved therein, to the fluorochemical cell, at a temperature that is below the temperature of the hydrogen fluoride; and passing electric current through the cell sufficient to cause replacement of one or more hydrogens of the substrate with fluorine.

As used within the present description, and in reference to an electrochemical fluorination process:

"Fluorinated" refers to chemical compounds having at least one carbon-bonded hydrogen replaced by a fluorine, and specifically includes perfluorinated compounds. "Perfluorinated" compounds refers to chemical compounds in which essentially all carbon-bonded hydrogens have been replaced by fluorines, although typically some residual hydride will be present in a perfluorinated composition; e.g., preferably less than 1 milligram hydride per gram perfluorinated product.

"Uninterrupted current" refers to the electric current flowing through an electrochemical fluorination cell, wherein the current is substantially constant; i.e., not substantially varied, and specifically, not periodically interrupted as described in the following description.

DETAILED DESCRIPTION

Figure 1:
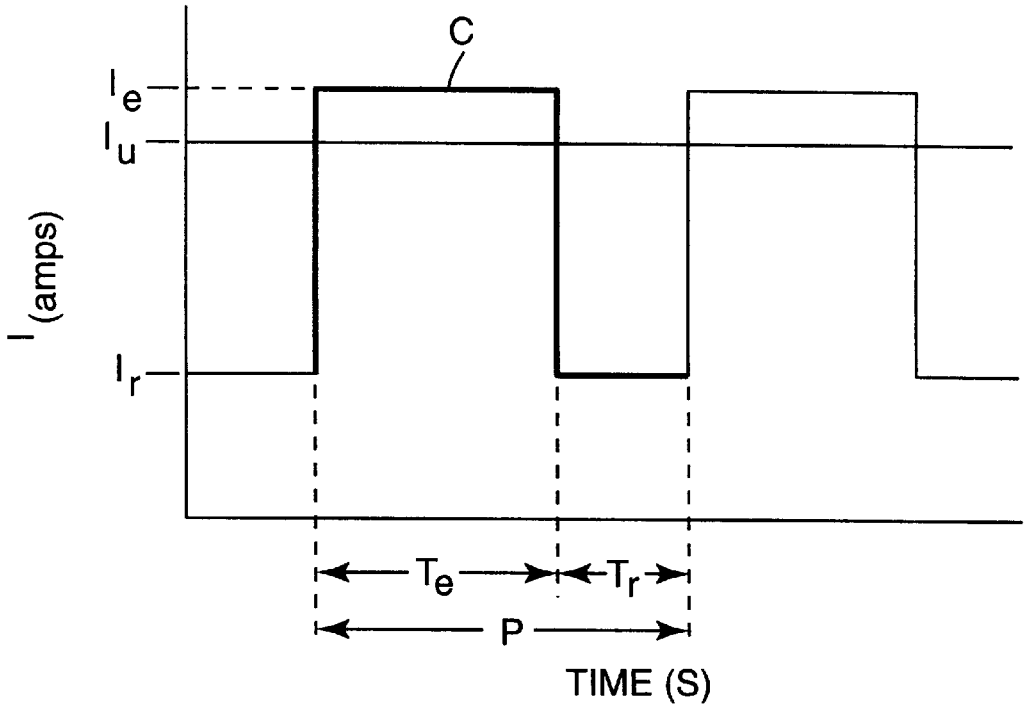
FIGS. 1 and 2 are graphs of current versus process time; the current is interrupted according to the present invention.

The present invention relates to a method of fluorinating a substrate to produce a fluorinated product. The process can be practiced according to methods similar to electrochemical fluorination methods generally known as "Simons" electrochemical fluorination.

The "Simons process" or the "Simons electrochemical fluorination process" is a commercial process for fluorinating a substrate dissolved or dispersed in liquid, anhydrous, hydrogen fluoride (IIF). Simons electrochemical fluorination can be carried out essentially as follows. A substrate and an optional conductivity additive are dispersed or dissolved in anhydrous hydrogen fluoride to form an electrolytic "reaction solution". One or more anodes and one or more cathodes are placed in the reaction solution and an electric potential (voltage) is established between the anode(s) and cathode(s), causing electric current to flow between the cathode and anode, through the reaction solution, and resulting in an oxidation reaction (primarily fluorination, i.e., replacement of one or more carbon-bonded hydrogens with carbon-bonded fluorines) at the anode, and a reduction reaction (primarily hydrogen evolution) at the cathode. As used herein, "electric current" refers to electric current in the conventional meaning of the phrase, the flow of electrons, and also refers to the flow of positively or negatively charged chemical species (ions); while wishing not to be bound by theory, it is believed that the current flowing through the reaction solution in the process is significantly a flow of such ionic chemical species through the reaction solution. The Simons process is well-known, and the subject of numerous technical publications. An early patent describing the Simons process is U.S. Pat. No. 2,519,983 (Simons), which contains a drawing of a Simons cell and its appurtenances. A description and photograph of laboratory and pilot plant-scale electrochemical fluorination cells suitable for practicing the Simons process appear at pages 416–418 of vol. 1 of "Fluorine Chemistry," edited by J. H. Simons, published in 1950 by Academic Press, Inc., New York. U.S.

Pat. No. 5,322,597 (Childs et al.) and U.S. Pat. No. 5,387,323 (Minday et al.) each refer to the Simons process and Simons cell. Further, electrochemical fluorination by the Simons process is described by Alsmeyer et al., Electrochemical Fluorination and Its Applications, *Organofluorine Chemistry: Principles and Commercial Applications* Chapter 5, pp. 121–43 (1994); S. Nagase in Fluorine Chem. Rev., 1(1) 77–106 (1967); and J. Burdon and J. C. Tatlow, *The Electrochemical Process for The Synthesis of Fluoro-Organic Compounds*, Advances in Fluorine Chemistry, edited by M. Stacey et al., (1960).

In the practice of the invention, a reaction solution is prepared which comprises hydrogen fluoride and a substrate. The hydrogen fluoride is preferably anhydrous hydrogen fluoride, meaning that it contains at most only a minor amount of water, e.g., less than about 1 weight percent (wt %) water. Such a minor amount of water present in the hydrogen fluoride is not unacceptable because this water is typically oxidized upon application of a voltage between the cathode and the anode.

The substrate can be any chemical compound or composition that comprises a carbon-bonded hydrogen, and that can be combined with hydrogen fluoride (optionally in the presence of a conductivity additive) to prepare a reaction solution through which electric current can be passed to cause fluorination of the substrate. The substrate can comprise any of a variety of organic moieties that can be straight, branched, saturated or unsaturated, partially fluorinated, and which can optionally include one or more of a variety of known functional groups including carbonyl, hydroxyl, sulfonyl, ether, amine, nitrile, aromatic, and substituted compounds. Such useful substrates are described, for example, in U.S. Pat. No. 2,519,983 (Simons), the description of which is incorporated herein by reference.

Examples of preferred organic substrates include pure hydrocarbon compounds such as alkanes (e.g. hexane); alkenes; aromatics; hydrocarbons that contain oxygen such as ethers and ether acids; hydrocarbons that contain nitrogen, such as amines (e.g., dibutyl amine); carboxylic acids and carboxylic acid halides, carboxylic acid esters and sulfonic acid esters; other sulfur-containing compounds such as alkanesulfonyl halides; mercaptans; thioesters; sulfones; alcohols; and other compounds.

A more preferred substrate can include a straight, branched, or cyclic alkane which is entirely hydrocarbon (e.g., a straight chain alkane, $C_nH_{2n+1}$, wherein n is from about 2 to 25, preferably from about 3 to 12, or a cyclic alkane, $C_nH_{2n}$, or a partially halogenated analog thereof (e.g., $C_nH_xX_y$) wherein X is a halogen such as fluorine or chlorine, and wherein x+y=2n+1 in the case of a straight or branched alkane, and x+y=2n in the case of a cyclic). Examples of particular alkanes include hexane and octane.

The reaction solution within the ECF cell includes an electrolyte phase comprising HF and an amount of substrate dissolved therein. In general, the substrate is preferably to some degree soluble or dispersible in liquid hydrogen fluoride. The substrate can be in the form of a liquid, solid, or gaseous vapor, and can be introduced to the hydrogen fluoride as appropriate for its physical state. Specifically, gaseous substrates can be bubbled through the hydrogen fluoride to prepare the reaction solution, or charged to the cell under pressure. Solid or liquid substrates can be dissolved or dispersed in the hydrogen fluoride. Optionally and preferably in the case of substrates that are relatively less soluble in hydrogen fluoride, the substrate can be introduced to the cell as a solute dissolved in a fluorochemical fluid, as described below.

Some substrates (e.g., alkanes), however, are not extremely soluble in hydrogen fluoride. These relatively insoluble substrates are considered to be difficult to fluorinate by Simons electrochemical fluorination methods. In general, it is desirable that the amount of substrate dissolved in the HF be as high as possible, e.g. approaching the solubility limit of the substrate within the HF. On the other hand, it is important to avoid the creation of a separate phase of the substrate within the ECF cell. A separate substrate phase, such as an alkane phase within the cell is to be avoided because if present, a substrate phase can cause significant problems during the electrochemical fluorination process. Specifically, if a separate alkane phase exists in the cell, the alkane substrate within this alkane phase can be polymerized to form a high molecular weight, polymerized, partially fluorinated tar which can accumulate within the electrolyte and which can build up as a coating on the electrodes and thereby deactivate the electrodes. The tar must be removed from the electrolyte and the electrodes, which involves significant time and expense. Thus, it is preferred to prevent the existence of a substrate phase within the ECF cell.

If the substrate is sufficiently soluble in the electrolyte phase there is little possibility that a separate substrate phase will develop in the cell. If, however, the substrate is relatively less soluble in the electrolyte (HF), then the possibility is greater that a separate substrate phase will develop in the cell. This can be the case with many alkane substrates, and therefore a separate fluorochemical phase within the reaction solution within the electrochemical fluorination cell can be beneficial when the substrate is an alkane such as hexane, heptane, octane, etc. The formation of a substrate phase when fluorinating alkane substrates that are relatively less soluble in HF can be prevented by ensuring the presence of a separate fluorochemical phase within the ECF cell, where the substrate is sufficiently soluble in the fluorochemical phase so that a separate substrate phase will not develop. The use of a separate fluorochemical phase in electrochemical fluorination is described, for example, in U.S. Pat. No. 5,387,323, the disclosure of which is incorporated herein by reference.

While wishing not to be bound by theory, a fluorochemical phase is believed to act as a "reservoir" for a substrate which has relatively poor solubility in the anhydrous hydrogen fluoride electrolyte, but much higher solubility in the fluorochemical phase. Amounts of substrate beyond that which can be dissolved in the hydrogen fluoride phase will be dissolved by the fluorochemical phase, thus preventing the substrate from accumulating separately in the cell and forming a substrate phase. Moreover, even if the substrate is relatively soluble in the hydrogen fluoride such that the potential of a separate substrate phase is not great, a fluorochemical phase can be desired, and can facilitate the fluorination process, because the increased solubility of the alkane in the fluorochemical phase gives a wider window of operation between starvation of the fluorination process (e.g., by lack of substrate in the electrolyte) and formation of either a separate substrate phase or a single substrate/fluorocarbon phase containing so much substrate that the phase floats on the electrolyte phase instead of sinking beneath it. Even further, the use of a fluorocarbon phase (particularly at a reduced temperature, as described below) to feed the substrate, provides an improved method of feeding a reliable, controlled, amount of the substrate into the cell.

The fluorochemical phase can comprise any fluorochemical material that allows relatively higher solubility of the substrate than does the electrolyte phase (HF), thus dissolving substrate that is not able to be dissolved by the HF phase, and thereby preventing the formation of a separate substrate phase. Preferably, the fluorochemical phase can comprise the electrochemical fluorination product.

Examples of fluorochemical compounds suitable for use as the fluorochemical phase include perfluorochemicals such as perfluoroalkanes, pentafluorosulfanyl-substituted perfluoroalkanes, perfluorocycloalkanes, perfluoroamines, perfluoroethers, perfluoropolyethers, perfluoroaminoethers, perfluoroalkanesulfonyl fluorides, perfluorocarboxylic acid fluorides, and mixtures thereof. Such compounds can contain some hydrogen or chlorine, e.g., preferably less than one atom of either hydrogen or chlorine for every two carbon atoms, but are preferably substantially completely fluorinated. Representative examples of such compounds include perfluorobutane, perfluoroisobutane, perfluoropentane, perfluoroisopentane, perfluorohexane, perfluoromethylpentane, perfluoroheptane, perfluoromethylhexane, perfluorodimethylpentane, perfluorooctane, perfluoroisooctane, perfluorononane, perfluorodecane, 1-pentafluorosulfanylperfluorobutane, 1-pentafluorosulfanylperfluoropentane, 1-pentafluorosulfanylperfluorohexane, perfluorocyclobutane, perfluoro(1,2-dimethylcyclobutane), perfluorocyclopentane, perfluorocyclohexane, perfluorotrimethylamine, perfluorotriethylamine, perfluorotripropylamine, perfluoromethyldiethylamine, perfluorotributylamine, perfluorotriamylamine, perfluoropropyltetrahydrofuran, perfluorobutyltetrahydrofuran, perfluoropoly (tetramethylene oxide), perfluoro(N-methylmorpholine), perfluoro(N-ethylmorpholine), perfluoro(N-propylmorpholine), perfluoropropanesulfonyl fluoride, perfluorobutanesulfonyl fluoride, perfluoropentanesulfonyl fluoride, perfluorohexanesulfonyl fluoride, perfluoroheptanesulfonyl fluoride, perfluorooctanesulfonyl fluoride, perfluorohexanoyl fluoride, perfluorooctanoyl fluoride, perfluorodecanoyl fluoride, and mixtures thereof. Due to considerations of cost, availability, and stability, perfluoroalkanes are preferred for use in the process of the invention. (See H. Saffarian, P. Ross, F. Behr, and G. Gard, J. Electrochem. Soc. 139, 2391 (1992).) Preferably, the fluorochemical phase can comprise the fluorinated product of the substrate.

The fluorochemical phase can be introduced to the ECF cell as a separate charge, can be introduced as a continuous feed, or, if chosen to be the electrochemical fluorination reaction product, can be allowed to build up within the cell. Of course, a combination of these techniques can also be used to provide the fluorochemical phase within the cell. Preferably, the fluorochemical phase can be introduced to the cell as an initial charge prior to the start of the ECF process, and, the substrate can be dissolved in a fluorochemical phase with the fluorochemical phase then being continuously fed into and/or recirculated (with substrate dissolved therein) back to the ECF cell to simultaneously provide both the fluorochemical phase and the alkane substrate. If an optional fluorochemical phase is present in the reaction solution, the amount of the fluorochemical phase can be any useful amount. The amount will generally be sufficient to create a separate fluorochemical phase within the electrochemical fluorination cell, but should not be so much as to interfere with the electrochemical fluorination process, which is generally thought to occur within the conductive electrolytic (HF) phase.

The reaction solution can contain any relative amounts of hydrogen fluoride, substrate, and, when the substrate is an alkane, a fluorochemical phase that will allow effective fluorination of the substrate, and that will preferably avoid the existence of a substrate phase within the ECF cell. A useful mass ratio of hydrogen fluoride to substrate will depend on the identity of the substrate and its solubility in HF. In the case of an alkane substrate, the amount of alkane should be sufficiently low to prevent the formation of a significant alkane phase within the reaction solution. Examples of useful amounts of HF versus substrate can be, for example, in the range from about 1:1 to 99:1 (hydrogen fluoride:substrate), preferably from about 75:25 to 99:1 hydrogen fluoride:substrate, and more preferably, in the case of an alkane substrate, from about 90:1 to 99:1 hydrogen fluoride:alkane substrate.

Generally, the reaction solution should be sufficiently electrically conductive to allow electric current to pass through the reaction solution in an amount sufficient to result in fluorination of the substrate. Pure liquid anhydrous hydrogen fluoride is substantially nonconductive. Therefore, to be conductive the reaction solution must contain an electrolytic component that allows passage of electric current through the reaction solution. A wide variety of organic substrates, particularly those containing functional groups, are both soluble in hydrogen fluoride and sufficiently electrolytic to allow passage of an effective amount of electrolyzing current. Thus, in some instances the organic substrate can function as the electrolytic component of the reaction solution. If, however, the organic substrate does not impart sufficient electrical conductivity to the hydrogen fluoride, the reaction solution can be made sufficiently electrically conductive by the addition of a conductive additive. For example, certain hydrocarbons and hydrofluorocarbons dissolve only to a small extent in hydrogen fluoride. Electrochemical fluorination of these types of compounds generally can require that a conductivity additive be added to the reaction solution. J. Burdon and J. C. Tatlow, *The Electrochemical Process for the Synthesis of Fluoro- Organic Compounds*, Advances in Fluorine Chemistry, edited by M. Stacey et al., (1960; U.S. Pat. No. 3,028,321 (Danielson), U.S. Pat. No. 3,692,643 (Holland), and U.S. Pat. No. 4,739,103 (Hansen).

As stated, the conductivity additive can be any usefully conductive material or compound, and can be either organically or ionically conductive. A short list of examples includes mercaptans such as butyl mercaptan and methyl mercaptan, esters, anhydrides, dimethyl disulfide (DMDS), and ionic salts such as potassium fluoride and lithium fluoride, just to name a few. Other usefully conductive compounds are well known in the art of electrochemical fluorination.

If a conductivity additive is included in the reaction solution, the conductivity additive can be included at any amount that will result in a reaction solution sufficiently conductive to allow fluorination of the substrate. It can be preferred to use the minimum amount of conductivity additive necessary to maintain a useful amount of electric conductivity of the reaction solution, because a minimal amount of conductivity additive can allow steady operation of a fluorination cell while maximizing efficient use of electricity, and may also reduce or minimize the amount of unwanted by-products caused by undesired fluorination of the conductivity additive. Most preferably, no conductivity additive is used unless necessary for stable cell operation. It is a specific advantage of the invention that improved conductivity of the fluorination cell can be achieved by using interrupted current, without the use of conductivity additives, or, with the use of a reduced amount of conductivity additive. The reduced amount of conductivity additive needed in the reaction solution allows increased yields of fluorinated product by reducing the amount of by-product created by the conductivity additives (e.g., when organic conductivity additives are used), and by reducing the amount of current wasted in causing the fluorination of such undesired by-products. As an example of a useful amount of conductivity additive, when required, the conductivity additive can be present in an amount of less than 20 weight percent conductivity additive, based on the amount of substrate; e.g., less than about 10 weight percent, or 5 weight percent, based on the amount of substrate.

The reaction solution can be exposed to reaction conditions (e.g., reaction temperature, reaction pressure, and electric voltage, current, and power) sufficient to cause fluorination of the substrate. In general, the reaction conditions can be any that are found to facilitate the production of a desired fluorinated product. Reaction conditions chosen for a particular fluorination process can be chosen depending on factors such as the size and construction of the electrochemical fluorination cell; the composition (i.e., identity and relative amounts) of each component of the reaction solution and the presence or absence of a conductivity additive; in a continuous reaction process, the flow rates of each component; the desired fluorinated product. etc.

The reaction temperature that the electrochemical fluorination cell is operated at can be any temperature that allows a useful degree of fluorination of the substrate. The reaction temperature can be chosen and controlled depending on the various factors identified above, as well as others. For instance, the reaction temperature can be chosen depending on the solubility of the substrate, the physical state of either the substrate or the fluorinated product (e.g., whether one or the other is desired to be in a liquid or a gaseous state), and also depending on other reaction conditions such as the reaction pressure. The reaction temperature can be chosen to be above the boiling point of the fluorinated product, in which case it can be beneficial to operate the cell in a pressure vessel under autogenous pressures. Reaction temperatures in the range from about −20° C. to 80° C. have been found to be useful. Temperatures in the range from about 20 to 65° C. can be preferred.

Useful reaction pressures have been found to be in the range from about ambient (atmospheric) pressure to about 65 psig ($4.48\times10^5$ Pa), and can preferably be in the range from about 5 to 45 psig ($0.34\times10^5$ to $3.10\times10^5$ Pa). Still, operating pressures outside of these ranges can also be used.

The electricity passed through the reaction solution can be any amount, as described by parameters including the current, voltage, and power of the electricity, that will result in fluorination of the substrate. In the practice of the present invention, the electric current is interrupted. The term "interrupted" when used with respect to an electrical parameter (e.g., current, current density, voltage, power, etc.), describes a periodic change in the value of that parameter through a regular, repeating, cycle. The term "cycle," as in current cycle, voltage cycle, or power cycle, etc., refers to a single, complete execution through the different levels through which the parameter varies. As an example, a current cycle describes a single execution through various levels of current that pass through a fluorination cell, beginning at a starting current level (taken as any arbitrarily chosen point of the cycle), continuing through operation at one or more other current levels, and returning to the starting point at the initial current level. An example of a current cycle is illustrated in FIG. 1, showing a graph of electric current versus process time. In the Figure, the electric current varies through a regular, periodic cycle (identified as the darkened portion of the cycle, labeled C), having a period P, an elevated current level $I_e$, and a reduced current level $I_r$. Period (P) is defined herein as the time taken for the execution of a single cycle. Examples of a voltage cycle and a power cycle are provided, respectively, in FIGS. 3 and 5, respectively, and are identified as $C_3$ and $C_5$.

Figure 3:
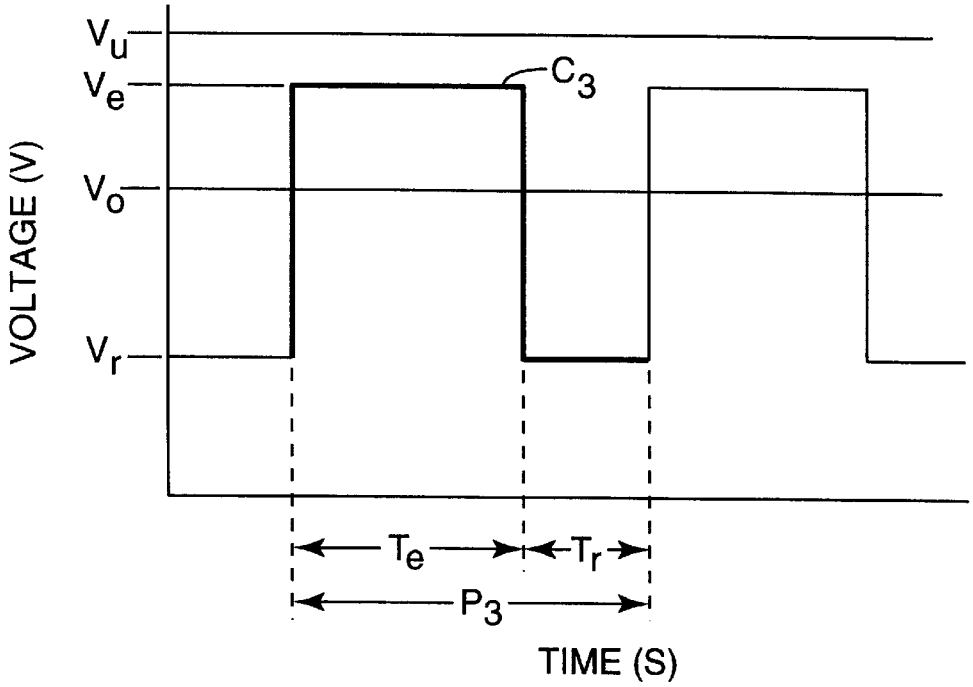
FIGS. 3 and 4 are graphs of voltage versus process time, with voltage varying according to the present invention.

In the practice of the invention, a cycle (e.g., a current cycle) can take any useful form, and can be described as a waveform. The cycle can be, for example, a square wave (see FIGS. 1 and 3), a substantially square wave, a sinusoidal wave (see FIG. 6), or any other periodic cycle. An idealized wave form is the square wave cycle illustrated in FIGS. 1, 3, and 5, relating to electric current, voltage, and power. FIG. 3, for example, illustrates variation (i.e., interruption) of cell voltage as follows: from a starting point at the beginning of the cycle $C_3$, and at a reduced voltage $V_r$, voltage increases to elevated voltage $V_e$, where it is maintained for a period $T_e$; voltage then decreases to a reduced voltage $V_r$, where it is maintained for a period of $T_r$ to complete a single cycle. This cycle repeats regularly throughout the fluorination process.

Figure 2:
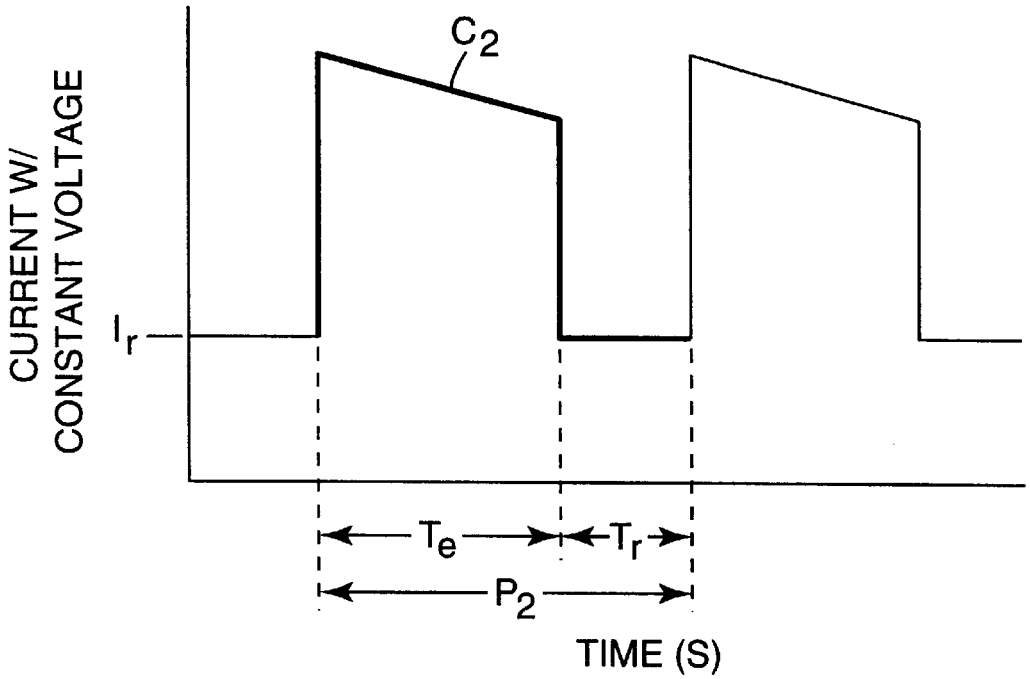
Figure 6:
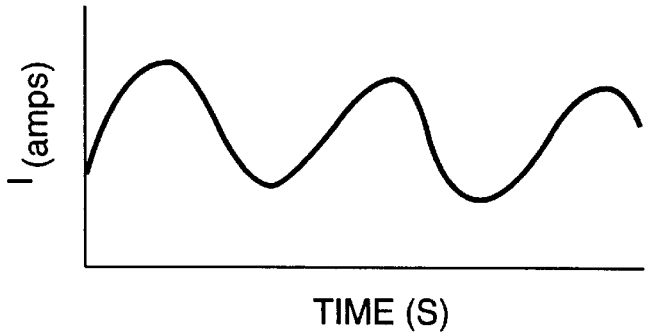
FIG. 6 is a graph of current versus time with current being interrupted (varying) in a sinusoidal manner according to the present invention.

In FIG. 1, the elevated current level is illustrated as constant within each cycle. In practice, however, neither the elevated nor the reduced current level need to be constant, and can vary throughout a cycle. This is shown in FIG. 2, which illustrates a plot of electric current versus process time wherein current (e.g., elevated current) is shown to slowly increase (while cell voltage is held constant). Furthermore, the elevated and reduced current levels can, if desired, be only the extremes of a cycle, wherein other portions of the cycle include intermediate current levels, such as is exemplified in FIG. 6, showing a sinusoidal waveform for a current cycle.

As stated above, the current flowing through the reaction solution can be any amount of current that will result in fluorination of the substrate. Current can be limited by the inherent properties of the electrochemical fluorination cell. The current is preferably insufficient to cause excessive fragmentation of the substrate, or to cause the liberation of fluorine gas during fluorination. For the sake of convenience, electric current measurements can be described in terms of current density, which is the current in amps passing through the reaction solution measured at an active site of the anode or anodes, divided by the area of the anode or anodes. As examples of current densities that have been found to be useful within the present invention, elevated current densities can be, for example, in a range from about 10 to 400 mA/cm$^2$ (milliamps per square centimeter), e.g., 200 or 300 milliamps, and are preferably in the range from about 20 to 160 mA/cm$^2$. Reduced current densities can be preferably substantially zero, e.g., in the range from about 0 to 2 mA/cm$^2$.

Periodic current cycle can be effected by any known and useful method of controlling electricity in an electrochemical fluorination cell. Because cell resistance in an electrochemical fluorination cell is relatively constant, current can be periodically cycled by controlling any one of the electric voltage across the reaction solution, the power flowing through the reaction solution, or the current flowing through the reaction solution, whichever is most convenient. Generally, the electrical parameter that is easiest to control is the voltage applied across a fluorination cell. Thus, while all possible methods of providing cycled current in an electrochemical fluorination cell are contemplated within the present invention, portions of the description will be described in terms of controlling the voltage applied across a reaction solution, in a manner to provide (given a relatively stable cell resistance) a periodically cycled current, and a similarly periodically cycled electric power flowing through the reaction solution.

Figure 7:
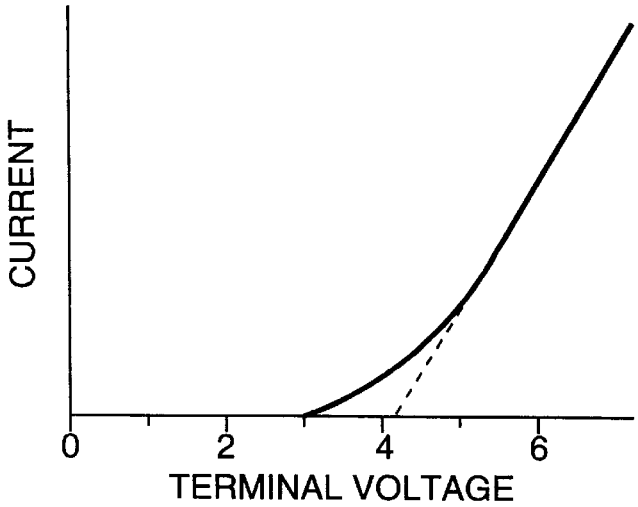
FIG. 7 is a graph of current versus terminal voltage of an electrochemical fluorination cell during a fluorination process.

The voltage applied across the reaction solution can be varied to result in a current cycle of the type described above. Specifically, the voltage can be varied through a regular, repeating, periodic cycle, wherein the cycle is defined by voltage levels comprising an elevated voltage and a reduced voltage. Such a voltage cycle will have a period and a waveform similar to the period and waveform described above for the periodically interrupted electric current. An example of a voltage cycle is illustrated in FIG. 3, showing a graph of cell voltage versus process time. In FIG. 3, voltage varies through a regular, periodic cycle $C_3$, having a period $P_3$, an elevated voltage $V_e$, and a reduced voltage $V_r$. FIG. 3 also identifies a zero current intercept voltage, $V_0$, defined for purposes of the present description as the minimum voltage required to result in fluorination of a particular substrate. The zero current intercept voltage $V_0$ can be empirically determined for a given fluorination reaction by plotting the current vs. voltage of electricity passing through a given reaction solution, and extrapolating the linear portion of the curve to the zero current intercept (see FIG. 7). The value of the zero current intercept voltage $V_0$ will be a function of a particular fluorination reaction, but, for purposes of the present description, will be approximated for the fluorination of an organic substrate as to be 4.2 volts.

In the practice of the invention, the elevated voltage ($V_e$) can be any voltage that results in fluorination of the substrate, e.g., a voltage that will cause current to flow through the reaction solution. To accomplish current flow and fluorination of the substrate, the elevated voltage should be at least equal to or greater than the zero current intercept voltage $V_0$ of the fluorination reaction, and for many fluorination reactions of organic substrates, can preferably be in a range from about 4.2 to about 9 volts (V), more preferably from about 4.5 to 6 V. The reduced voltage can be any voltage that will result in a reduced cell resistance relative to cell resistance when operated with uninterrupted current. Preferably, the reduced voltage is of a value that will result in substantially no current flowing through the reaction solution (e.g., $I_r$ will be substantially zero). This can preferably be accomplished by providing a reduced voltage that is below the zero current intercept voltage $V_0$. It should be noted that although FIGS. 3 and 4 each show a reduced voltage of the same polarity as the elevated voltage, and although it is preferable that the reduced voltage be positive, this is not a requirement of the present invention as it would be possible, if desired, to use a reduced voltage having a negative polarity compared to the elevated voltage; e.g., a voltage that would be shown as a negative voltage on either of FIG. 3 or 4. Voltage, in terms of cell voltage, reduced voltage, elevated voltage, etc., refers to voltage measured between cathode and anode.

Figure 4:
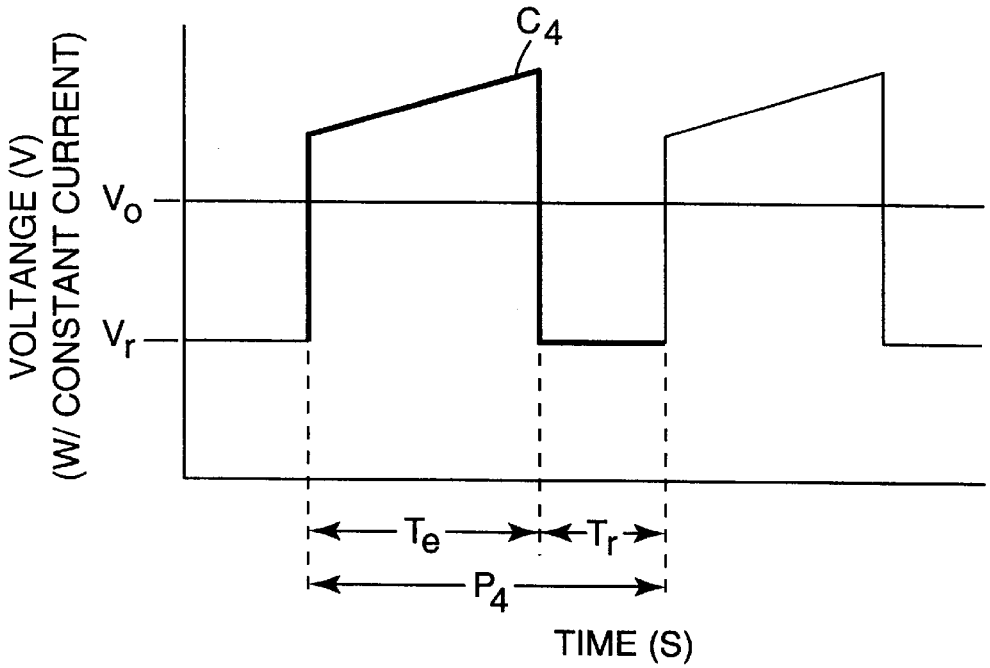

In FIG. 3, the elevated voltage ($V_e$) is shown to be a constant value. In practice, however, neither the elevated voltage nor the reduced voltage are required to be completely or substantially constant, and either or both can vary throughout a pulse cycle. As an example, FIG. 4 illustrates voltage cycle $C_4$ wherein the elevated voltage is not constant through the pulse cycle. In FIG. 4, the cell voltage is shown to increase from the reduced voltage to an elevated voltage greater than the zero current intercept voltage $V_0$. The elevated voltage then gradually increases before falling back to the reduced voltage level $V_r$. This phenomena, often referred to as voltage "drift," is thought to be a result of films that can build on the surface of the anode, gradually increasing the resistance of the cell. As a further example of a non-constant elevated or reduced voltage, consider again FIG. 6, showing a sinusoidal current cycle; a cell operating with a sinusoidal current cycle will have a similar sinusoidal voltage cycle.

Figure 5:
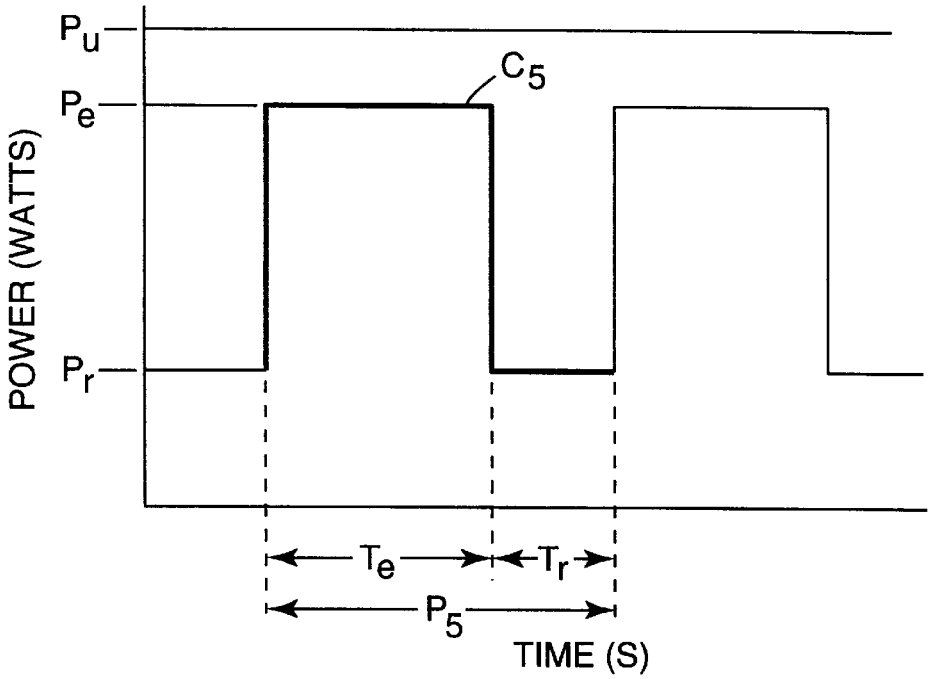
FIG. 5 is a graph of electric power versus process time, with power varying according to the present invention.

The value of the electric power, in watts or joules/sec, passing through the reaction solution can also vary as described above for electric current and voltage. Specifically, the power can vary through a regular, repeating, periodic cycle, wherein the power varies between elevated and reduced power levels. Such a cycle will have a period and a waveform analogous to that described above for varying electric current and voltage. An example of a power cycle is illustrated in FIG. 5, showing a graph of power versus process time. In the Figure, the power varies through a regular, periodic cycle $C_5$, having a period $P_5$, an elevated power level $P_e$, and a reduced power level $P_r$.

The amount of electric current passing through the reaction solution, in terms of electric power, can be any amount of current that in combination with the other reaction conditions of the fluorination process will result in fluorination of the organic substrate. Electric power is defined as voltage times current (V×I), and therefore, the amount of electric power used in the fluorination process is dependent on the current and voltage used, and on the size of the fluorination cell.

As stated above, the electric current flowing through the fluorination cell can be controlled by any control means useful to provide a periodically interrupted electric current through the reaction solution. Many such control means will be understood by those skilled in the art of electricity and electrochemical fluorination. As one specific example of a means to control current, the electric voltage applied across the reaction solution can be periodically interrupted (i.e., reduced) by connecting the anode and cathode to a power supply having a cycle timer with two predetermined voltage set points, one set point corresponding to an elevated voltage and another set point corresponding to a reduced voltage. The timer can cycle between these two set points at preselected timing intervals. Briefly, a second example of control means useful for effecting a periodically cycled current through the reaction solution is by directly controlling the current by use of a programmable logic controller (PLC) on a power supply.

It has been found that interrupting the electric current through an electrochemical fluorination cell can result in several advantages in a fluorination process. Specifically, the electrical resistance (in ohms) of an electrochemical fluorination cell can be reduced compared to the electrical resistance of the same cell under the same conditions except that an uninterrupted current flows through the reaction solution. As a matter of convenience, resistance of a fluorination cell can be described in terms of a "normalized resistance." "Normalized resistance," as used within the present description, refers to a measurement of resistance across a fluorination cell, as calculated according to the following equation:

$$R_n=(V_{avg}-V_0)/current\ density \quad (1)$$

In formula 1, $V_{avg}$ is the average voltage of the cell (when current is interrupted the average elevated voltage ($V_e$) can be used), $V_0$ is defined above, and current density is as defined. The normalized resistance has dimensions of resistance times area, and units, e.g., of ohm-ft$^2$, or ohm-dm$^2$.

The use of a normalized resistance is convenient for purposes of this description because normalized resistance can be considered to be relatively constant for a given fluorination cell and fluorination process. Therefore, normalized resistance is a convenient measure of improvement between operation with interrupted current and operation with uninterrupted current.

The normalized resistance of an electrochemical cell operating according to the present invention can vary, but as an exemplary range $R_{f1}$ can be in the range from about 0.01 to 0.05 ohm-ft$^2$.

A result of the reduced resistance within the electrochemical fluorination cell of the present invention is that the cell can operate at an elevated voltage ($V_e$) that is relatively lower than the voltage that the cell would otherwise operate at with uninterrupted current. This effect is illustrated in FIG. 3, showing the voltage that the fluorination cell would operate at under conditions of uninterrupted current $V_u$, compared to the voltage when operated with interrupted current (elevated voltage) $V_e$. Moreover, operation at a relatively lower voltage provides an electrochemical fluorination process that requires a reduced amount of total electric power, which reduces electricity costs, reduces the amount of heat generated during the fluorination process that would otherwise have to be removed, and, when practiced in the fluorination of certain substrates and optional conductivity additives, may reduce the production of undesired by-products.

In the practice of the invention, the cycle period P can be any period that is sufficient to cause the advantage of reducing the resistance of the electrochemical fluorination cell compared to resistance during operation with uninterrupted current. Cycle periods as low as 0.4 seconds have been found to be useful as well as cycle periods of 1.5, 3, 10, 30, 150 or 300 seconds.

The portion of the cycle period wherein the current is at elevated current and elevated voltage (identified herein as $T_e$), and the portion of the cycle period at reduced current and reduced voltage (identified herein as $T_r$) can be any amounts of time that will be effective in the fluorination process to produce a fluorinated product, and sufficient to cause a relatively reduced cell resistance. It can be preferable to minimize the reduced current time period ($T_r$), both in absolute terms and in terms relative to the elevated period, because the reduced current time period is non-productive. That is, fluorination of the substrate occurs as a result of operation at elevated current, e.g., at a rate proportional to the ratio of elevated current ($T_e$) to cycle time or cycle period (P). Therefore, the percentage of the current cycle at elevated current ($T_e$) is desirably maximized, and the amount of time at reduced current ($T_r$) is desirably minimized. Preferred reduced voltage periods ($T_r$) can be less than 50% of the total period P, and are even more preferably less than about 20%, 10%, or less, of the total period P. In practice, e.g., in large scale production, the reduced period $T_r$ can preferably be in the range from about 1 to 5, e.g., 3 seconds, with the elevated period $T_e$ being preferably 150, 200, or 300 seconds. Also in practice, to optimize the operation, if the elevated voltage increases gradually the elevated period $T_e$ can be reduced; contrariwise, if the elevated voltage decreases or is relatively low the elevated period $T_e$ can be increased.

The types of compounds ("electrochemical fluorinated product," or "fluorinated product") that can be prepared according to the present invention are various, and will depend primarily on the chemical identity of the substrate. In general, the desired fluorinated product will be a fluorinated or perfluorinated analog of the substrate; i.e., the fluorinated product will have a carbon backbone of a length similar to the length of the substrate, but will have one or more of the carbon-bonded hydrogens replaced with fluorine. Still, it is possible for the substrate to react during the fluorination process to produce fluorinated product containing fewer or more carbon atoms than the substrate. Preferably, the fluorinated product will be substantially perfluorinated. Generally, the fluorinated product compound will be completely saturated because any unsaturation within the substrate will react and fluorine will add across the unsaturation. On the other hand, certain functional groups which might be present on the substrate can be essentially unaffected by the electrochemical fluorination process (e.g., sulfonyl groups, S═O bonds in sulfones, sulfates, and alkanesulfonyl halides, and the C═O bonds in carboxylic acids and their derivatives), and will remain intact at least to a useful degree in the fluorinated product. Specific examples of fluorinated products that can be prepared from hydrocarbon alkanes include perfluoroalkanes such as those having from about 2 to 20 carbons, e.g., perfluoroethane, perfluoropropane, perfluorobutane, perfluorohexane, perfluorooctane, and the like.

Electrochemical fluorination cells in which the process of the present invention can be performed (also referred to herein as the "cell" or the "fluorination cell") may be any conventional electrochemical fluorination cell known in the art of electrochemical fluorination. In general, a suitable fluorination cell can be constructed of components including a cell body comprising a reaction vessel capable of containing the reaction solution, and electrodes that may be submerged into the reaction solution for the passage of current through the reaction solution. Generally, in a relatively large-scale setting, cells useful in the practice of the invention can comprise a cell body constructed typically of carbon steel in which is suspended an electrode pack comprising a series of alternating and closely-spaced cathode plates (typically but not necessarily made of iron, nickel, or nickel alloy) and anode plates (typically but not necessarily made of nickel). The plates are immersed in the reaction solution, a voltage is applied to the electrodes, and current passes through the reaction solution.

Electrochemical fluorination cells that can be useful in the practice of the present invention are described, for example, in U.S. Pat. No. 2,519,983, GB 741,399 and 785,492. Other useful electrochemical fluorination cells include the type generally known in the electrochemical fluorination art as flow cells. Flow cells comprise a set (one of each), stack, or series of anodes and cathodes, where reaction solution is caused to flow over the surfaces of the anodes and cathodes using forced circulation. These types of flow cells are generally referred to as monopolar flow cells (having a single anode and a single cathode, optionally in the form of more than a single plate, as with a conventional electrochemical fluorination cell), and, bipolar flow cells (having a series of anodes and cathodes). Bipolar flow cells are described, for example, in U.S. Pat. No. 5,474,657 the description of which is incorporated herein by reference.

Other details of the Simons electrochemical fluorination process and cell will be omitted in the interest of brevity, and the disclosures of such technology in the above-identified references can be referred to for such detail, which disclosures are incorporated herein by reference.

In a particularly preferred embodiment, the process of the invention can be carried out by introducing an alkane substrate into an electrochemical fluorination cell (e.g., a Simons cell or a flow cell) containing anhydrous hydrogen fluoride, or to which anhydrous hydrogen fluoride is simultaneously or subsequently added. Preferably the reaction solution comprises a fluorochemical phase and a hydrogen fluoride phase, and the alkane substrate can be introduced to the cell as a solute dissolved in the fluorochemical phase, with the fluorochemical phase being continuously fed and/or recirculated into the cell.

Optionally and preferably, a separate feed decanter can contain a reservoir of an alkane substrate dissolved in the fluorochemical phase (feed stream), which is then fed into the cell. Such a decanter allows control of the temperature of the feed stream, and thereby allows control of the concentration of the substrate (e.g., alkane) within the feed stream.

Specifically, the substrate and the fluorochemical can both be contained and mixed within the decanter, with the amount of substrate being dissolved in the fluorochemical phase being such that the fluorochemical phase is saturated with the substrate. This can be easily accomplished by charging an excess of the substrate to the decanter so that a separate substrate phase exists above the fluorocarbon phase. The amount of substrate flowing into the cell will depend on the amount of substrate dissolved in the fluorochemical phase, which will depend on the temperature of the fluorochemical phase, because solubility of the substrate in the fluorochemical phase will be dependent on temperature. Thus, changing the temperature setpoint of the decanter will allow control and manipulation of the concentration of the substrate in the feed stream, and therefore in the fluorocarbon phase of the cell, and hence in the electrolyte. Such control of the temperature of the feed stream can allow the prevention of a separate substrate phase from developing within the cell. In general, the temperature of the feed stream is preferably below the operating temperature of the cell, and is preferably at least about 5° C. below the operating temperature of the cell, more preferably at least about 10° C. below, e.g., 15 or 20° C. below the operating temperature of the cell.

Feeding the fluorochemical phase at a relatively reduced temperature ensures that the amount of the alkane substrate within the feed stream, and therefore the fluorochemical phase of the reaction solution, does not exceed the solubility limits of either the fluorochemical phase or the hydrogen fluoride phase at operating temperature within the cell, thus preventing the formation of a separate phase of the alkane substrate. This procedure has been found to prevent overfeeding (the addition of substrate to the cell in excess of the rate at which the substrate is fluorinated and removed as a product) and significantly reduces the formation of tars, current blocking, and fouling of the electrodes.

Figure 8:
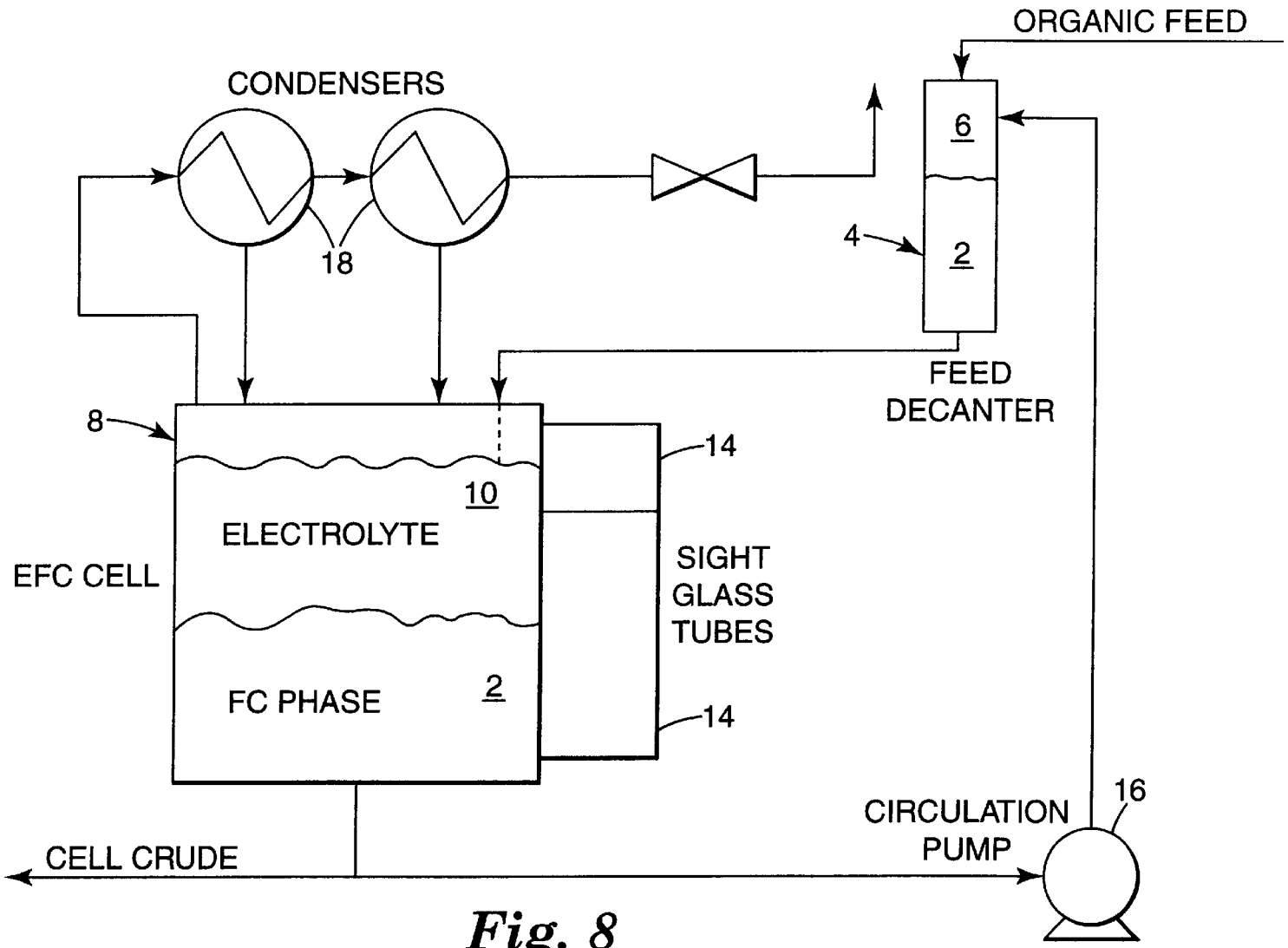
FIG. 8 schematically illustrates an embodiment of the invention wherein the fluorinated product (fluorochemical phase) is recirculated and combined with the alkane substrate feed in a decanter, and the substrate is fed to the cell as a solute within the fluorochemical phase.

An illustration of this embodiment of the process is shown in FIG. 8. In the Figure, a solution of fluorochemical phase 2, saturated with alkane substrate 6, is held in feed decanter 4. The decanter also contains alkane phase 6, which is the organic feed. Fluorochemical phase 2 is fed to electrochemical fluorination cell 8 containing anhydrous hydrogen fluoride (electrolyte phase 10) and optionally an initial amount of fluorochemical phase 2. The cell is optionally and preferably equipped with sight glass tubes 14 to monitor the levels of the fluorochemical phase 2 and the hydrogen fluoride electrolyte phase 10. The electrochemical cell can contain a drain valve (not shown) for removal of fluorinated product, and for optional connection to a circulation pump 16 which permits a portion of the fluorochemical phase (preferably containing fluorinated product) to be recycled back to the decanter. The circulation pump has been found to improve cell performance by enhancing the mixing process that transfers the alkane substrate to the fluorochemical compound phase, and then to the electrolyte phase, and by increasing mass transfer of the alkane substrate to and from the electrodes. The cell can optionally be fitted with refrigerated condensers 18 for condensing vapor comprising hydrogen fluoride, alkane substrate, and fluorochemicals of the fluorochemical phase and/or fluorochemical product, which can be sent back to the cell.

As will be understood by artisans skilled in electrochemical fluorination, the embodiment of the invention illustrated in FIG. 8, wherein substrate feed is fed into the cell as a solute in a fluorochemical phase, can be useful with different types of ECF setups including flow cell applications, bipolar flow cell applications, and conventional Simons cell applications, can be useful with pulsed, interrupted, or continuous current, and, can be useful with any type of substrate. Although this embodiment is useful for any substrate, it can be especially useful with substrates that are relatively insoluble in hydrogen fluoride and therefore tend to form a separate phase within the electrochemical fluorination cell, such as alkanes and especially higher alkanes such as octane.

EXAMPLE 1

A 2.5 liter electrochemical fluorination cell of the type described in U.S. Pat. No. 2,713,593, equipped with a −40° C. overhead condenser, 0.40 $ft^2$ (3.7 $dm^2$) nickel anode and a voltage controller having a cycle timer, was charged with a solution of 97 wt. % anhydrous hydrogen fluoride and 3 wt. % dimethyl disulfide. A mixture of octanesulfonyl fluoride containing 6 wt. % dimethyl disulfide was fed continuously to the cell, which was operated at 30 psig, 54° C., the current controlled at 53 amps/$ft^2$ (5.7 amps/$dm^2$) and relatively constant voltage of 6.0 volts.

After the cell reached steady-state the current was increased to 58 A/$ft^2$ (6.2 amps/$dm^2$) and interrupted every thirty seconds by reducing the cell voltage to 3.3 volts ($V_r$) for 3 seconds causing the current to fall to essentially zero ($T_e$=27 seconds, $R_r$=3 seconds). The average elevated cell voltage $V_e$ (the voltage during $T_e$) was 5.5 volts. This was a reduction from the constant uninterrupted cell voltage of 6.0 volts, in spite of the increased current. It was expected that the voltage would have increased to 6.2 volts. The cell was operated (with minimal interruptions) under this cycled sequence for 14 days during which perfluorooctanesulfonyl fluoride was produced at an average rate of 18 g/50 amp-hours.

EXAMPLE 2

Using essentially the procedure described in Example 1 for cycled current conditions, and maintaining the same current cycle sequence, octanesulfonyl fluoride was fed to the cell without the added dimethyl disulfide. The current was controlled at 56 amps/$ft^2$ (6.0 amps/$dm^2$), and the voltage reached a steady-state elevated voltage of 5.6 volts. The reduced voltage was 3.3V. Perfluorooctanesulfonyl fluoride was produced at an average rate of 21 g/50 amp-hours.

EXAMPLE 3

An electrochemical fluorination cell according to U.S. Pat. No. 2,713,593 having a 27 $ft^2$ (251 $dm^2$) anode was charge with an electrolytic mixture containing 80 wt. % hydrogen fluoride and 2.5 pounds of dimethyl disulfide at a temperature of 54° C. Over a period of 3 days a mixture of 94 wt. % octanesulfonyl fluoride and 6 wt. % dimethyl disulfide was fed to the cell until steady state was achieved;

voltage with uninterrupted current was 5.8 volts, the current was 1521 amps, and the normalized resistance was 0.028 ohm-ft$^2$ (0.26 ohm-dm$^2$).

The current was then interrupted every 72 seconds for 8 seconds ($T_e$=72 seconds, $T_r$=8 seconds) causing the cell voltage to drop compared to the uninterrupted cell voltage, and also causing an increase in the current (current density), and a drop in normalized resistance; voltage during interrupted current operation was 5.6 volts, current was about 1814 amps and the normalized resistance was 0.021 ohm-ft$^2$ (0.19 ohm-dm$^2$).

After an additional two days of operating with interrupted current, DMDS was removed from the feed; the feed was changed to neat octanesulfonyl fluoride (containing no dimethyl disulfide). The current averaged 1800 amps (67 amps/ft$^2$), the voltage averaged 6.0 volts, and the normalized resistance was 0.027 ohm-ft$^2$ (0.25 ohm-dm$^2$). The product perfluorooctanesulfonyl fluoride was produced at an average rate of 21 g/50 amp-hours.

EXAMPLE 4

An electrochemical, bipolar flow fluorination cell of the type described in U.S. Pat. No. 5,286,352 was initially charged with electrolyte comprising 2 wt. % dimethyl disulfide and 2.7 wt. % octanesulfonyl fluoride in anhydrous HF. The electrolyte was heated to 55° C. by means of external heaters. A mixture of 94 wt. % octanesulfonyl fluoride and 6 wt. % dimethyl disulfide was continuously fed to the cell. After 11 hours 114 grams of additional dimethyl disulfide was added to improve cell conductivity. The normalized resistance ranged from 0.035 to 0.054 ohms-ft$^2$ (0.32-0.50 ohms-dm$^2$) and the current densities ranged from 35 to 55 amps/ft$^2$ (3.8–5.9 amps/dm$^2$).

After 28.5 hours the current was cycled as in Example 3 ($T_e$=72 seconds, $T_r$=8 seconds). The current density increased to 125 amp/ft$^2$ (13.4 amps/dm$^2$) and the normalized resistance decreased to the range from 0.012 to 0.014 ohms-ft$^2$ (0.11–0.13 ohm-dm$^2$). After 33 hours, the external heaters were turned off allowing the cell to cool to 49° C. without adversely affecting the operation of the cell. This shows that a bipolar flow cell can be operated at subcooled (operating at a temperature below or a pressure above the bubble point of the reaction solution) conditions by using interrupted current without higher normalized resistance.

EXAMPLE 5

Using essentially the procedure of Example 1, the cell was charged with a mixture of 99.3 wt. % hydrogen fluoride and 0.7 wt. % dimethyl disulfide. Dibutyl amine was fed continuously at a rate of 6.1 g/50 amp-hours, then lowered to 5.7 g/50 amp-hours when the HF concentration in the electrolyte was below 95%. Perfluorobutane was produced at a rate of 17 g/50 amp-hours and a higher boiling byproduct was produced at 4 g/50 amp-hours. The current density was 59 amps/ft$^2$ (6.3 amps/dm$^2$). The average voltage was 6.1V.

After 12,000 hours of operation, the current was interrupted as in Example 3 ($T_e$=72 seconds, $T_e$=8 seconds). The higher boiling byproduct was produced at a lower rate of 2 g/50 amp-hours and the perfluorobutane was produced at a rate of 19 g/50 amp-hours. The average elevated voltage was 5.3 V.

EXAMPLE 6

Using essentially the procedure of Example 1 and a cell having 0.68 ft$^2$ (6.3 dm$^2$) anode surface area, a single −40° C. condenser and a voltage controller having a cycle timer, was charge with an electrolyte solution of 98.3 wt. % anhydrous hydrogen fluoride and 1.7 wt. % dimethyl disulfide. After a short "run-in" time to achieve steady state operating conditions, a mixture of triamylamine containing 6 wt. % dimethyl disulfide was fed continuously to the cell, which was operated at 25 psig and 50° C. The current was cycled through a cycle of 8 seconds elevated current and 72 seconds reduced current. During $T_e$ the current was controlled at 50 A; during $T_r$ the voltage was controlled at about 3 V and no current passed. The cell was run for 364 hours under these conditions at a current of 50 A. The following is a tabular summary of the run, excluding the initial cell "run-in":

| Operation with Interrupted Current | | | |
|---|---|---|---|
| Total run time: | 320.5 Hr. | Avg. current: | 44 A |
| Total charge passed: | 14086 AH | Avg. current density | 65 A/ft$^2$ (7.0 amps/dm$^2$) |
| Average cell voltage | 6.5 V | Avg. normalized resistance: | 0.035 ohm-ft$^2$ (0.32 ohm-dm$^2$) |
| Total organic added: | 1697 g | Avg. organic feed rate: | 6.02 g/50 AH |
| | | Avg. % of theor. | 92.8% |
| | | Avg. $(C_5F_{11})_3N$ production rate: | 18.53 g/50 AH |
| | | Total Crude $(C_5F_{11})_3N$: | 5220 g |

At the end of this period, the cell was running at steady-state, at a current of 50 A. The electrolyte concentration was 97% HF. The current listed is the average current over the entire cycle period, including both $T_e$ and $T_r$. The average current during $T_e$ was 49 A. The "Avg. (C5F 11)3N production rate" was calculated from G.C. results and from residual analysis.

After the first 344 hours of the run, the cell was switched to uninterrupted operation. The conductivity of the cell immediately began to drop and the cell voltage increased to the preset limit of 7.5 volts. The conductivity continued to decay for 127 hours, the electrolyte concentration at the end of this period was 90% HF and the normalized resistance increased, at which point interrupted current operation was resumed. As interrupted current operation was resumed, the normalized resistance dropped to less than 0.025, the current increased to 55 A at an elevated voltage of 6.2 V, while restoring the HF electrolyte concentration to 95%.

The following is a summary of the operation with uninterrupted current.

| Operation with Uninterrupted Current | | | |
|---|---|---|---|
| Total run time: | 126.7 Hr. | Avg. current: | 40 A |
| Total charge passed: | 5014 AH | Avg. current density | 58 A/ft$^2$ (6.2 A/dm$^2$) |
| Average cell voltage | 7.7 V | Avg. normalized resistance: | 0.060 ohm-ft$^2$ (0.56 ohm-dm$^2$) |
| Total organic added: | 651 g | Avg. organic charge rate: | 6.49 g/50 AH |
| | | Avg. % of theor. | 100.0% |
| | | Avg. crude $(C_5F_{11})_3N$ production rate: | 14.20 g/50 AH |
| | | Total Crude $(C_5F_{11})_3N$ produced: | 1424 g |

Samples of crude product from operation both with and without current interruption were analyzed for higher boiling polymeric and oligomeric products by drying the samples down to a constant weight in a 240° C. oven. The product collected during the uninterrupted current portion of the run averaged 8.3% higher boiling polymeric and oligomeric products, but the product collected during the interrupted current portion of the run averaged only 4.4% higher boiling products. Thus pulsed operation reduces the amounts of unwanted by-products.

EXAMPLE 7

Using essentially the procedure of Example I octanoyl chloride was fluorinated with both interrupted and uninterrupted current operation in a cell having 0.40 $ft^2$ anode surface area, a single −40° C. condenser and a voltage controller having a cycle timer. The cell was operated at 50° C. The results are as follows:

| Operation with Uninterrupted Current | | | |
|---|---|---|---|
| Total run time: | 378.4 Hrs. | Avg. current: | 15 A |
| Total charge passed: | 5721 AH | Avg. current density | 38 A/$ft^2$ (4.1 A/$d^2$) |
| Average cell voltage | 6.8 V | Avg. normalized resistance: | 0.07 ohm-$ft^2$ (0.64 ohm-$dm^2$) |
| Total organic added: | 1063 g | Avg. organic charge rate: | 9.29 g/50 AH |
| | | Avg. % of theor. | 93.3% |
| Total high boilers produced: | 2386 g | Avg. high-boiling product production rate: | 20.85 g/50 AH |

| Operation with Interrupted Current | | | |
|---|---|---|---|
| Total run time: | 213.8 Hrs | Avg. current: | 17 A |
| Total charge passed: | 3696 AH | Avg. current density | 43 A/$ft^2$ (4.6 A/$dm^2$) |
| Average cell voltage | 5.5 V | Avg. normalized resistance: | 0.03 ohm-$ft^2$ (0.28 ohm-$dm^2$) |
| Total organic added: | 653 g | Avg. organic charge rate: | 8.84 g/50 AH |
| | | Avg. % of theor. | 88.7% |
| Total high boilers produced: | 1478 g | Avg. high-boiling product production rate: | 19.99 g/50 AH |

EXAMPLE 8

A designed experiment was conducted to examine the variables of total cycle time, length of time "off" Tr, percentage of time "off" as a function of total cycle time, and elevated voltage. The cell described in Example 1 was initially charged with 2 kg of anhydrous hydrogen fluoride, 42 g of dimethyl disulfide and 20 g of octanesulfonyl fluoride. A mixture of 94 wt. % octanesulfonyl fluoride and 6 wt. % dimethyl disulfide was fed continuously to the cell at a rate of 9.8 g/50 Ahr. We attempted to control the current at 20–21 amps during the "on" part of the cycle (Te) and between 2 and 3V during the "off" part of the cycle Tr. This was accomplished for all runs except the run having P=0.4 and Tr=0.04, as the voltage was reduced only to approximately 4 volts. Each subsequent run was continued by varying the pulse cycle. The efficiency of the cell operation was measured by calculating the "normalized resistance".

| | | | | | | |
|---|---|---|---|---|---|---|
| Cycle Time (sec) | 80 | 80 | 1.5 | 0.4 | 0.4 | uninterrupted |
| Time "off" (sec) Tr | 4 | 16 | 0.15 | 0.2 | 0.04 | — |
| % time in reduced voltage | 5 | 20 | 10 | 50 | 0.10 | — |

-continued

| | | | | | | |
|---|---|---|---|---|---|---|
| Length of run (hr) | 20.1 | 26.7 | 22.2 | 41.9 | 64.3 | 47.9 |
| Charge passed (A-hr) | 397 | 443.9 | 430 | 457.6 | 1237.4 | 959 |
| Total A-hr/Total hr | 19.8 | 16.6 | 19.4 | 10.9 | 19.2 | 20 |
| Avg. Ve | 5.1 | 5.0 | 5.1 | 5.2 | 6.8 | 7.6 |
| Avg. I.e. | 20.8 | 20.8 | 20.8 | 20.8 | 20.8 | 20.0 |
| Normalized resistance during Te (ohm/$ft^2$) | 0.017 | 0.015 | 0.017 | 0.019 | 0.050 | 0.068 |

The data of the Table indicates that a variety of different cycle periods and Te and Tr values can be effective to reduce the normalized resistance of an electrochemical fluorination cell. Notice, however, that at a very low cycle time (0.4 second) in combination with a very low Tr (0.04) the least improvement in normalized resistance resulted.

EXAMPLE 9

An electrochemical, bipolar flow fluorination cell of the type described in U.S. Pat. No. 5,286,352 was operated at 340 kPa, 48° C. (subcooled conditions), with an electrolyte superficial velocity of 0.5 m/s. Octanesulfonyl fluoride and dimethyl disulfide were independently fed to the cell at the mass ratio of 0.94 to 0.06 weight percent. The cell was operated at a current density of 97 amps/$ft^2$ (10.4 amps/$dm^2$). The initial average cell voltage was 5.7 V, increasing over a period of 90 minutes to 6.9 V. The "normalized resistance" increased over the same time period from 0.016 to 0.028 ohms-$ft^2$ (0.15–0.26 ohms-$dm^2$).

The same electrochemical cell was then operated at 340 kPa, 48° C. (subcooled conditions), with an electrolyte superficial velocity of 0.5 m/s. Octanesulfonyl fluoride and dimethyl disulfide were fed to the cell at the mass ratio of 0.98 to 0.02 weight percent. The cell was operated at a current density of 150 amps/$ft^2$ (16.1 amps/$dm^2$) with the current interrupted every 180 seconds for 4 seconds (176 seconds "on", 4 seconds "off"). The average cell voltage was 6.4 V for a normalized resistance of 0.015 ohms-$ft^2$ (0.14 ohms-$dm^2$).

This example shows that a bipolar flow cell operated at subcooled conditions experiences a rise in voltage when current is uninterrupted, and stable operation of the cell could be achieved using interrupted current.

EXAMPLE 10

A 2.5 liter electrochemical fluorination cell of the type described in U.S. Pat. No. 2,713,593, equipped with two overhead condensers having brine temperatures of 0° C. and −40° C., 0.40 $ft^2$ (3.7 $dm^2$) nickel anode, an external loop to allow product removal, and a voltage controller having a cycle timer, was charged with 1000 g of $C_6F_{14}$, 41 g DMDS, and 40 g hexane, and filled with anhydrous HF. Hexane was fed continuously to the cell, which was operated at 35 psig, 45° C., and the current was controlled at 50 amps/$ft^2$ (5.4 amps/$dm^2$) and a relatively constant voltage of 5.3 volts. The current was interrupted every 80 seconds by reducing the cell voltage to less than 4 volts ($V_r$) for 4 seconds causing the current to fall to essentially zero ($T_e$=80 seconds, $T_r$=4 seconds).

About 140 hours into the cell run, the current was increased to 100 A/$ft^2$ (10.8 amps/$dm^2$). The average elevated cell voltage $V_e$ (the voltage during $T_e$) was initially about 6.2 volts and gradually fell to about 5.4 volts over a period of several days. About 370 hours into the cell run, the current was increased to 150 A/ft$^2$ (16.1 A/dm$^2$) and $V_e$ remained between 5 and 6 volts for the rest of the run, which was continued at steady-state conditions for an additional 500 hours. The normalized resistance during this period averaged about 0.0083 ohm-ft$^2$ (0.077 ohm-dm$^2$) (in the calculation the value of $V_o$ used was 4.2 and the current density was the average elevated current density. Hexane was fed to maintain a constant concentration of 4 to 6% hexane in the circulating fluorochemical product phase. Intermittently, a portion of the product was removed, while maintaining the presence of a fluorochemical phase in the cell.

What is claimed is:

1. A process for the electrochemical fluorination of an organic substrate, to perfluorinate the substrate, the process comprising the steps of:

providing organic substrate comprising at least one carbon-bonded hydrogen;

providing, in an electrochemical fluorination cell, a reaction solution comprising the substrate and hydrogen fluoride;

passing electric current through the reaction solution sufficient to cause replacement of the hydrogens of the substrate with fluorine, the electric current being interrupted through a current cycle defined by current levels comprising an elevated current and a reduced current;

wherein the period of the current cycle is less than about 300 seconds; and wherein the current is interrupted in such a manner that the resistance of a cell operated with interrupted current is lower than the resistance of the cell operated with uninterrupted current.

2. The process of claim 1, wherein the elevated current provides a current density flowing through the reaction solution in the range from about 10 to 400 milliamps per square centimeter.

3. The process of claim 1, wherein the reduced current is substantially zero.

4. The process of claim 3, wherein the reduced current is in the range from about 0 to 2 milliamps per square centimeter.

5. The process of claim 1, wherein the voltage across the cell varies through a cycle defined by an elevated voltage and a reduced voltage.

6. The process of claim 5, wherein the elevated voltage is greater than the zero current intercept of the fluorination reaction.

7. The process of claim 6, wherein the elevated voltage is in the range from about 4.2 to 9 volts.

8. The process of claim 5, wherein the reduced voltage is sufficient to result in current flowing through the reaction solution to be substantially zero.

9. The process of claim 5, wherein the reduced voltage is below about 4.2 volts.

10. The process of claim 1, wherein the electric power through the reaction solution varies between an elevated power and a reduced power.

11. The process of claim 1, wherein the period of the current cycle is 0.4 seconds or more.

12. The process of claim 11, wherein the period of the current cycle is 10 seconds or more.

13. The process of claim 1, wherein the current is reduced for less than 50% of the cycle.

14. The process of claim 1, wherein the current is reduced for less than 25% of the cycle.

15. The process of claim 1, wherein the current is reduced for from about I to 10% of the cycle.

16. The process of claim 1, wherein the reaction solution further comprises a conductivity additive.

17. The process of claim 16, wherein the conductivity additive comprises dimethyl disulfide.

18. The process of claim 1, wherein the reaction solution contains substantially no conductivity additive.

19. The process of claim 1, wherein the substrate comprises a sulfonyl compound, an amine or an alkane.

20. The process of claim 19 wherein the process produces a perfluorinated sulfonyl compound.

21. The process of claim 20 wherein the process produces perfluorooctane sulfonyl fluoride.

22. The process of claim 19 wherein the process produces a perfluorinated amine.

23. The process of claim 19 wherein the alkane substrate comprises one or more of hexane or octane.

24. The process of claim 19 wherein the process produces perfluorooctane.

25. The process of claim 19, wherein the process produces perfluorohexane.

26. The process of claim 1, wherein the organic substrate comprises octane sulfonyl fluoride.

27. The process of claim 1, wherein the organic substrate and the reaction solution are provided into a flow cell.

28. The process of claim 27, wherein the cell flow is a bipolar flow cell.

29. The process of claim 27, wherein the electrochemical fluorination process is conducted at elevated temperature and pressure.

30. The process of claim 29, wherein the process temperature is below the boiling point of the reaction solution at the operating pressure.

31. The process of claim 1 wherein the substrate comprises an alkane sulfonyl halide.

32. The process of claim 1 wherein the reaction solution consists essentially of substrate, hydrogen fluoride, and optional conductivity additive.

33. The process of claim 1 wherein the current cycle comprises a reduced current level period $T_r$ in the range from about 1 to 5 seconds.

34. A process for the electrochemical fluorination of an organic substrate, to perfluorinate the substrate, the process comprising the steps of:

providing organic substrate comprising at least one carbon-bonded hydrogen;

preparing a reaction solution comprising the substrate and hydrogen fluoride;

applying an electric voltage across the reaction solution sufficient to induce an electric current to flow through the reaction solution and cause replacement of the hydrogens of the substrate with fluorine, the electric voltage being varied according to a cycle defined by voltage levels comprising an elevated voltage and a reduced voltage;

wherein the period of the voltage cycle is less than about 300 seconds; and wherein the voltage is controlled in such a manner that the resistance of a cell operated with varied voltage is lower than the resistance of the cell operated with unvaried voltage.

35. The process of claim 34, wherein the elevated voltage is above a zero intercept current voltage ($V_o$), and the reduced voltage is below the zero intercept current voltage ($V_o$).

36. The process of claim 34 wherein the reaction solution consists essentially of substrate, hydrogen fluoride, and optional conductivity additive.

37. The process of claim 34 wherein the voltage cycle comprises a reduced voltage level period $T_r$ in the range from about 1 to 5 seconds.

* * * * *

UNITED STATES PATENT AND TRADEMARK OFFICE

CERTIFICATE OF CORRECTION

PATENT NO. : 6,267,865 B1 
DATED : July 31, 2001
INVENTOR(S) : Stephen D. Polson et al.

It is certified that error appears in the above-identified patent and that said Letters Patent is hereby corrected as shown below:

Title page,
Item [75], please delete "John C. Smeltzer" and "Charles F. Kolpin" as named inventors.
Item [63], in the subheading "Cross-Reference to Related Application," please delete "Continuation-in-part of application No. 09/074,830, filed on May 8, 1998, now abandoned, and a continuation of application No. 09/070,382, filed on Apr. 30, 1998, now abandoned." and insert in place thereof -- Continuation-in-part of application No. 09/070,382, filed on April 30, 1998, now abandoned, and a continuation-in-part of application No. 09/074,830, filed May 8, 1998, now abandoned. --

Column 11,
Line 16, delete "$V_c$" and insert in place thereof -- $V_e$ --.

Column 16,
Line 63, delete the word "charge" and insert in place thereof -- charged --.

Column 17,
Line 66, delete the word "charge" and insert in place thereof -- charged --.

Column 18,
Line 31, delete "(C5F 11)3N" and insert in place thereof -- $(C_5F_{11})_3N$ --.

Column 19,
Example 7, in the Table, under Operation with Uninterrupted Current at "Total charge passed:", please delete "(4.1 $A/d^2$)" and insert in place thereof -- 4.1 $A/dm^2$ --.

UNITED STATES PATENT AND TRADEMARK OFFICE

CERTIFICATE OF CORRECTION

PATENT NO. : 6,267,865 B1
DATED : July 31, 2001
INVENTOR(S) : Stephen D. Polson et al.

It is certified that error appears in the above-identified patent and that said Letters Patent is hereby corrected as shown below:

Column 21,
Line 65, after the word "about", delete "I" and insert in place thereof -- 1 --.

Signed and Sealed this

Twenty-fourth Day of September, 2002

*Attest:*

*Attesting Officer*

JAMES E. ROGAN
*Director of the United States Patent and Trademark Office*